US005273069A

United States Patent [19]

Akiyama et al.

[11] Patent Number: 5,273,069

[45] Date of Patent: Dec. 28, 1993

[54] OPERATION VALVE WITH PRESSURE COMPENSATION VALVE

[75] Inventors: Teruo Akiyama; Kiyoshi Shirai; Naoki Ishizaki; Koji Yamashita; Shinichi Shinozaki, all of Kawasaki, Japan

[73] Assignee: Komatsu, Ltd., Tokyo, Japan

[21] Appl. No.: 793,385

[22] PCT Filed: May 15, 1991

[86] PCT No.: PCT/JP91/00638

§ 371 Date: Mar. 16, 1992

§ 102(e) Date: Mar. 16, 1992

[87] PCT Pub. No.: WO91/18211

PCT Pub. Date: Nov. 28, 1991

[30] Foreign Application Priority Data

May 15, 1990 [JP] Japan ..... 2-122960

[51] Int. Cl.[5] ..... F15B 13/02

[52] U.S. Cl. ..... 137/596; 60/452; 91/447; 137/596.13

[58] Field of Search ..... 60/452; 91/447; 137/596, 596.13

[56] References Cited

U.S. PATENT DOCUMENTS

| | | | |
|---|---|---|---|
| 3,707,988 | 1/1973 | Hodgson | 137/596.13 X |
| 3,878,864 | 4/1975 | Schurger | 137/596.13 |
| 5,000,001 | 3/1991 | Christensen et al. | 137/596 X |
| 5,188,147 | 2/1993 | Shirai et al. | 137/596.13 X |

FOREIGN PATENT DOCUMENTS 3841507 6/1989 Fed. Rep. of Germany .

*Primary Examiner*—Gerald A. Michalsky

*Attorney, Agent, or Firm*—Armstrong, Westerman, Hattori, McLeland & Naughton

[57] ABSTRACT

An operation valve having a pressure compensation valve of relatively simple non-complicated internal body structure. In the valve body, a load pressure introducing passage, a check valve and a restriction are formed inside the spool comprising the operation valve. An intermediate pressure between an inlet pressure and an outlet pressure of the compensation valve which is arranged in the valve body, may be supplied to a pressure receiving section of the pressure compensation valve through an oil hole of the spool. The operation valve with the pressure compensation valve is of simple construction and may be easily manufactured.

2 Claims, 3 Drawing Sheets

OPERATION VALVE WITH PRESSURE COMPENSATION VALVE

TECHNICAL FIELD

The present invention relates to an operation valve with a pressure compensation valve which is incorporated in an hydraulic circuit for supplying a hydraulic oil from an hydraulic source to a plurality of hydraulic actuators.

BACKGROUND OF THE ART

To supply a hydraulic oil of a single hydraulic source, i.e. an hydraulic pump to a plurality of hydraulic actuators, it is sufficient to provide a plurality of operation valves in a discharge passage from the hydraulic pump and change the operation valves to supply the hydraulic oil to each of the hydraulic actuators. According to the arrangement, however, it becomes to present a tendency that the hydraulic oil is supplied to only an actuator having a small load and not supplied to an hydraulic actuator of heavy load when the hydraulic oil is supplied to a plurality of the hydraulic actuators at a time and where the hydraulic actuators are not under such circumstances that they are actuated with substantially the same load.

For instance, Japanese Patent Laid Open Publication No. 59-197603 of Showa 59 (the year 1984) proposed an hydraulic circuit as one for solving the above mentioned problem.

The hydraulic circuit of the hydraulic control means in the prior art, which the present invention is subjected to, will be shown in FIG. 3, where it is shown diagrammatically.

In the prior art, an operation valve 2 is provided with a plurality of flow passages respectively which are divided from a discharge passage 1*a* of an hydraulic pump 1 and a pressure compensation valve 5 are provided respectively with hydraulic oil passages 4 for connecting each of the operation valves 2 and each of hydraulic actuators 3. The pressure of each of the hydraulic oil passages 4, i.e. the most high pressure of that among each of the hydraulic actuators 3 under load, is detected by means of a shuttle valve 6 and each of the detected load pressures acts on each of the compensation valves 5 so that the compensation valves 5 are set in a pressure corresponding to the load pressure. As the result, the pressures at the outlets of the operation valves 2 becomes equal to each other and when each of the operation valves 2 are operated simultaneously, a hydraulic oil may be supplied to each of the hydraulic actuators 3 at a divided flow ratio which is in proportion to an opening area of each of the operation valves 2.

According to the above mentioned hydraulic circuit, with function of the pressure compensation valves 5, it is possible to carry out a division of the flow amount in proportion to the opening areas of the operation valves 2 regardless of a heavy or light load acting on each of the hydraulic actuators 3. Therefore, the hydraulic oil from the single hydraulic pump 1, may be supplied to each of the hydraulic actuators 3 in proportion to an amount of operation of each of the operation valves 2.

However, according to such a prior art, where the operation valves 2 and the compensation valves 5 are constructed separately, piping therefore becomes complex and therefore the operation valves 2 and the compensation valves 5 are assembled. However, the compensation valve 5 is incorporated in the operation valve 2 provided in its valve body and oil openings for detecting a load pressure have to be formed and therefore it cannot evade that its construction becomes complex. Of course, it requires a precision in processing the valve.

DISCLOSURE OF THE INVENTION

The present invention has an object to solve the abovementioned problems and to provide an operation valve with a pressure compensation valve without making the interior of the valve body thereof complex.

In an operation valve with a pressure compensation valve in which a changeable spool and the pressure compensation valve are incorporated therein, the present invention is characterized by that an end of an oil hole formed along an axis of the spool is opened on the side of a load pressure detecting port and another end thereof provides a check valve and further a thin opening is formed on another end of the check valve to open to a return passage and a small opening is provided at an intermediate portion of the oil hole to open to an outlet passage.

Thus, as a load pressure introduction passage, the present invention provides the oil hole which is formed with the spool which is mounted on the interior of the valve body and then the check valve and a restricted portion are arranged, so that an intermediate pressure between the inlet port pressure and the outlet port pressure of the pressure compensation valve may be supplied to a pressure receiving portion of the pressure compensation valve through the spool. Therefore, the entire construction of the operation valve is simplified in comparison with the prior art.

BRIEF DESCRIPTION OF THE DRAWINGS

FIG. 1 and FIG. 2 are the drawings for describing a preferable embodiment of an operation valve with a pressure compensation valve according to the present invention in which:

FIG. 1 is a longitudinal sectional view of the operation valve with the pressure compensation valve, FIG. 2 is an hydraulic circuit in which the operation valve with the pressure compensation valve of the present invention is incorporated, and FIG. 3 is an hydraulic circuit diagrammatically showing an essential portion of the prior art which the present invention is subjected to.

BEST MODE FOR PRACTICING THE PRESENT INVENTION

Next, an embodiment of an operation valve with a pressure compensation valve according to the present invention will be described with reference to the drawings.

Figure 2:
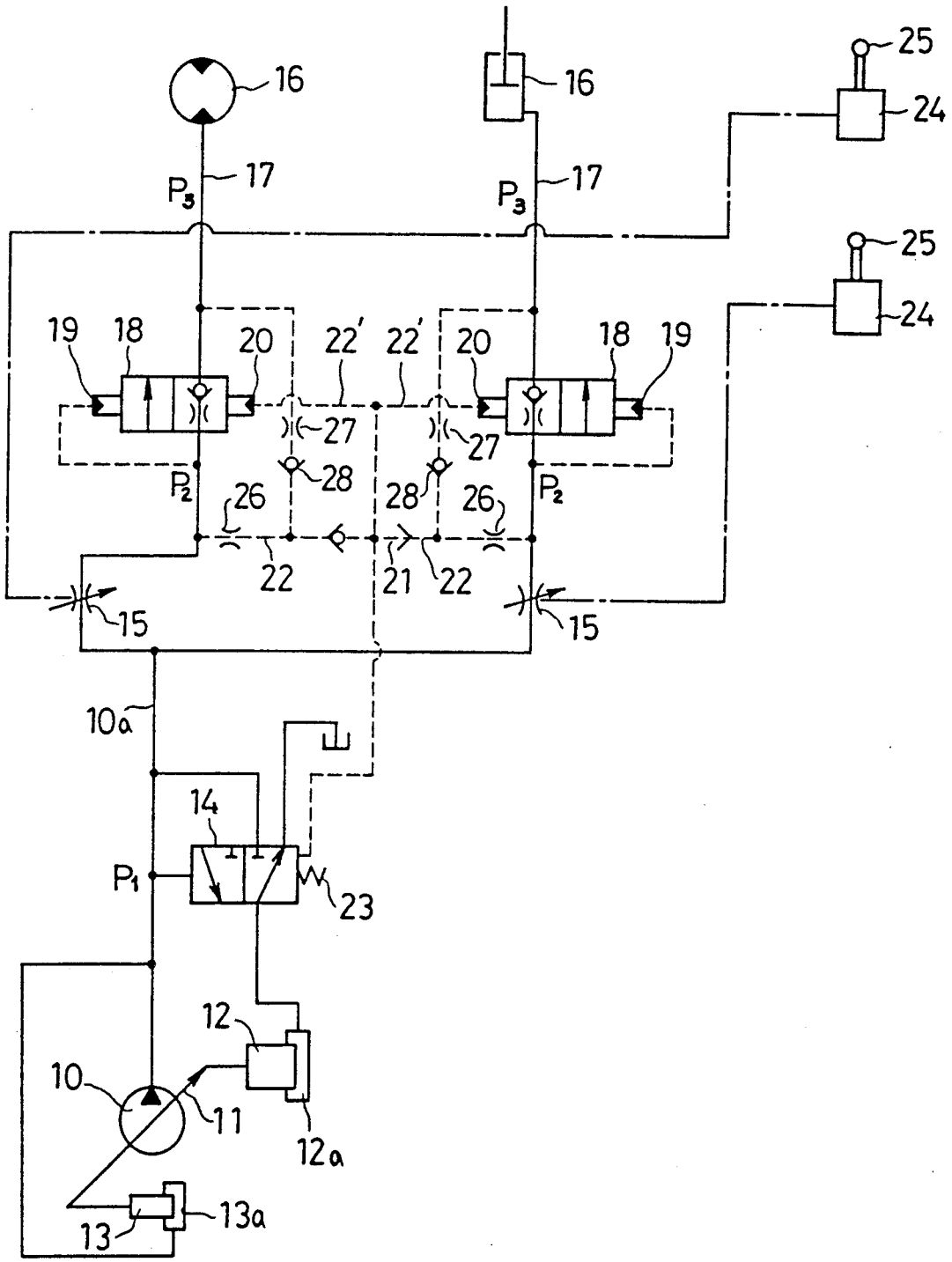
Figure 3:
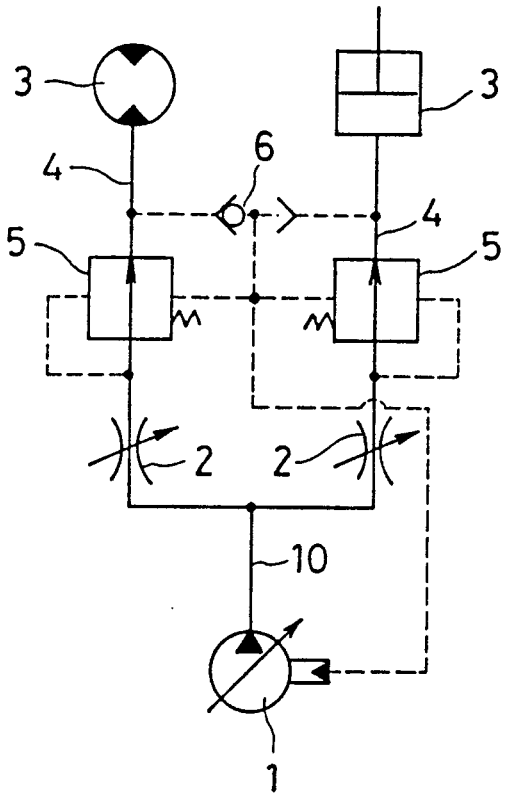

First, with reference to FIG. 2, it is described about an hydraulic circuit, in which the operation valve with the pressure compensation valve according to this invention is incorporated. An hydraulic pump 10 as an hydraulic oil supplying source comprises a variable discharge hydraulic pump which varies an amount of discharge per rotation by changing an angle of an inclined plate 11. The inclined plate 11 is moved to incline to decreasing an amount of discharge by means of a large diameter piston 12 belonging to the hydraulic pump 10 and to increasing an amount of discharge by means of a small diameter piston 13 belonging to the hydraulic pump 10. A pressure receiving chamber 12*a* to the large diameter piston 12 is connected to a discharge passage 10*a* of the hydraulic pump 10 via a control valve 14 of the hydraulic pump 10 and the pressure receiving chamber 12*a* is communicated with or shut off the discharge passage 10*a* and a pressure receiving chamber 13*a* to the small diameter piston 13 is connected to the discharge passage 10*a* of the hydraulic pump 10.

The discharge passage 10*a* of the hydraulic pump 10 is divided plurally corresponding to a plurality of hydraulic actuators 16 which are actuated by the hydraulic oil supplied from the hydraulic pump 10 and each of the divided hydraulic oil introduction passages 17 is provided with an operation valve 15. A pressure compensation valve 18 is provided respectively between the operation valves 15 and hydraulic actuators 16 in each of the hydraulic oil introduction passages 17. Each of the compensation valve 18 is operated on the side of a low pressure by means of the hydraulic oil which is communicated with a first pressure receiving section 19 and also operated on the side of a high pressure by means of the hydraulic oil which is communicated with a second pressure receiving section 20. The first pressure receiving section 19 is connected to the side of the inlet port of the pressure compensation valve 18 (the upstream side of the hydraulic oil introduction passage 17) and the hydraulic oil of the inlet port pressure thereof acts on the first pressure receiving section 19. The second pressure receiving section 20 is connected to a control hydraulic oil passage 22' from the side of the outlet port of a shuttle valve 21. The shuttle valve 21 is connected to the hydraulic oil introduction passage 17 via a load introduction passage 22 so as to introduce a maximum load pressure.

The control valve 14 has a relationship that it is operated with a pressure in the discharge passage 10*a* of the hydraulic pump 10. In a normal state, the pressure receiving chamber 12*a* of the large diameter piston 12 for operating the inclined plate is communicated with a drain port by means of a return spring 23. When a discharge pressure $P_1$ becomes high, an hydraulic oil is supplied from the discharge passage 10*a* to the pressure receiving chamber 12*a* of the large diameter piston 12 so that the discharge pressure $P_1$ acts on the large diameter piston 12 so as to incline the inclined plate 11 to decreasing a capacity thereof, and when the discharge pressure $P_1$ becomes low, the pressure receiving chamber 12*a* of the large diameter piston 12 is communicated with the drain port so as to incline the inclined plate 11 to increasing a capacity thereof.

Each of the operation valves 15 is operated by a pilot control valve 24 having an operation lever 25, which pilot valve 15 is mounted for instance on a machine body which is controlled, in such a direction that the opening area of the valve 15 increases in proportion to the pilot pressure oil. The pilot pressure oil is in proportion to an operation stroke of the operation lever 25.

The load introduction passage 22 is connected to the oil inlet port and the outlet port for hydraulic oil introduction of the pressure compensation valve 18 and a first restriction 26, a second restriction 27 and a check valve 28 are provided in an intermediate portion of the load introduction passage 22, and it is so constructed that the intermediate pressure of the hydraulic oil between the inlet port pressure $p_2$ and the outlet port pressure $P_3$ of the pressure compensation valve 18 is introduced into the shuttle valve 21 as a load pressure $P_{LS}$.

Namely, an intermediate portion between the first restriction 26 and the second restriction 27 of the load introduction passage 22 is connected to the inlet port of the shuttle valve 21. The flow-in hydraulic oil is flown respectively into the inlet port of the shuttle valve 21 as the load pressure $P_{LS}$ at an intermediate pressure determined by a ratio of the restriction areas between the first restriction 26 and the second restriction 27. Both of the load pressures $P_{LS}$ are compared to each other and the higher pressure is output as a maximum load pressure and then it acts on the second pressure receiving section 20 of the pressure compensation valve 18.

According to the hydraulic circuit, since the intermediate pressure between the inlet port pressure and the outlet port pressure of the pressure compensation valve 18 is introduced into the second pressure receiving section 20 of the pressure compensation valve 18 as a load pressure, an error of distribution of the flow due to a pressure loss of the pressure compensation valve 18, may be decreased and also it may prevent misoperation of the pressure compensation valve 18 due to a flow force.

The hydraulic circuit as mentioned above necessitates the shuttle valve 21, the check valve 28, a plurality of the restrictions 26 and 27, and flow passages for communicating them with one another, and therefore the operation valve with the pressure compensation valve becomes very complex where these elements are constructed into a single valve in an ordinary manner. In the case of the operation valve with the pressure compensation valve according to the present invention, it may be constructed simply.

Next, an example of the operation valve with the compensation valve according to the present invention will be described with reference to FIG. 1.

The operation valve 15 and the pressure compensation valve 18 are incorporated in a valve main body 30. The drawings showing the embodiment show one of the systems of the operation valve 15 and the pressure compensation valve 18 which are aligned plurally with one another in an actual arrangement.

A spool 32 is inserted into a spool hole 31 which is formed to penetrate a valve body 30, so that the spool 32 is slidable in a direction of an axis thereof and the ends thereof projects from the spool hole 31. The spool 32 provides a first small diameter section 35, a second small diameter section 38, a third small diameter section 41 and a fourth small diameter section 44. The first small diameter section 35 is so constructed as to communicate with and shut off a first inlet passage 33 and a first outlet passage 34, arranged in the valve body 30. The second small diameter section 38 is so constructed as to communicate with and shut off a first return passage 36 and a first tank communicating passage 37, arranged in the valve body 30. The third small diameter section 41 is so constructed as to communicate with and shut off a second inlet passage 39 and a second outlet passage 40, arranged in the valve body 30. The fourth small diameter section 44 is so constructed as to communicate with and shut off a second return passage 42 and a second tank communicating passage 43, arranged in the valve body 30. The spool 32 is held by means of a pair of springs 45 in a neutral position for closing each of the passages 33·34, 36·37, 39·40, and 42·43. Each of the springs 45 receives a reactive force from a connector 46 in the shape of a cap which is mounted on the outer portions of the valve body 30 respectively and locates right and left in the drawings. Each of the connectors 46 forms therein a first pressure receiving section $46_1$ or a second pressure receiving section $46_2$, respectively. A pilot pressure oil of the pilot control valve 24 (See FIG. 2) supplied to each of the first pressure receiving section moves the spool 32 in right and left directions so as to communicate each of the relative passages with one another and shut off the same. Thus, the operation valve 15 is constructed by these elements.

The pressure compensation valve 18 is arranged in the valve body 30 in parallel with a constructive section of the operation valve 15 and constructed as follows. A poppet 51 is inserted into a lateral opening bridging the first outlet passage 34 and the first return passage 36. A plug 50 having an opening for connection is screwed from the outside of the valve body 30. A movable member **52*b* is inserted into the plug 50 and freely slided in such a state that an axis of the movable member 52*b* and that of the poppet 51 are aligned. A spring 52 is arranged in a spring chamber 52*a*, which is formed in the plug 50 behind the movable member 52*b*, to give a propelling force to the poppet 51. A valve seat 53 is formed with the valve body 30 in such a manner that the first outlet passage 34 and the first return passage 36 are closed when the poppet 51 is pressurized by the spring 52. The outlet pressure of the poppet 51 is set with a balance of the load pressure supplied into the spring chamber 52*a* from the outlet of a shuttle valve 21, which is referred to hereinafter, and the inlet pressure of the poppet 51**.

By the way, another pressure compensation valve 18 is also arranged symmetrically with to the above mentioned pressure compensation valve 18 between the second outlet passage 40 and the second return passage 42.

The first outlet passage 34 is connected to a first actuator connecting port 47 which is communicated with the first return passage 36 via the pressure compensation valve 18. The second outlet passage 40 is connected to a second actuator connecting port 48 which is communicated with the second return passage 42 via the pressure compensation valve 18, which is positioned left in the drawings.

A shuttle valve 21 is disposed in a rod 55, which is inserted into a hole 54 formed with the valve body 30 in an opposite direction of the operation valve 15 or each of the pressure compensation valves 18, and which rod 55 is screwed to the inlet portion of the hole 54 and fixed by a locknut 56. The shuttle valve 21 has such a construction that a ball 58 is inserted into a hole 57 drilled from the inside end of the rod 55 along an axis of the rod and that the ball is held by a retainer 59 which is inserted into the hole 57 from the opening end thereof. An inlet of the shuttle valve 21 is faced to an intermediate position of the spool 31 of the operation valve 15 and opened to a load pressure detection port 61 of the valve body 30 via an oil opening 60 and another inlet of the shuttle valve 21 is opened to a load pressure detection port of another operation valve which is not shown in the drawings but has the same construction as that of the aforementioned operation valve, and an outlet thereof is connected to a spring chamber **52*a* of each pressure compensation valve 18**.

Figure 1:
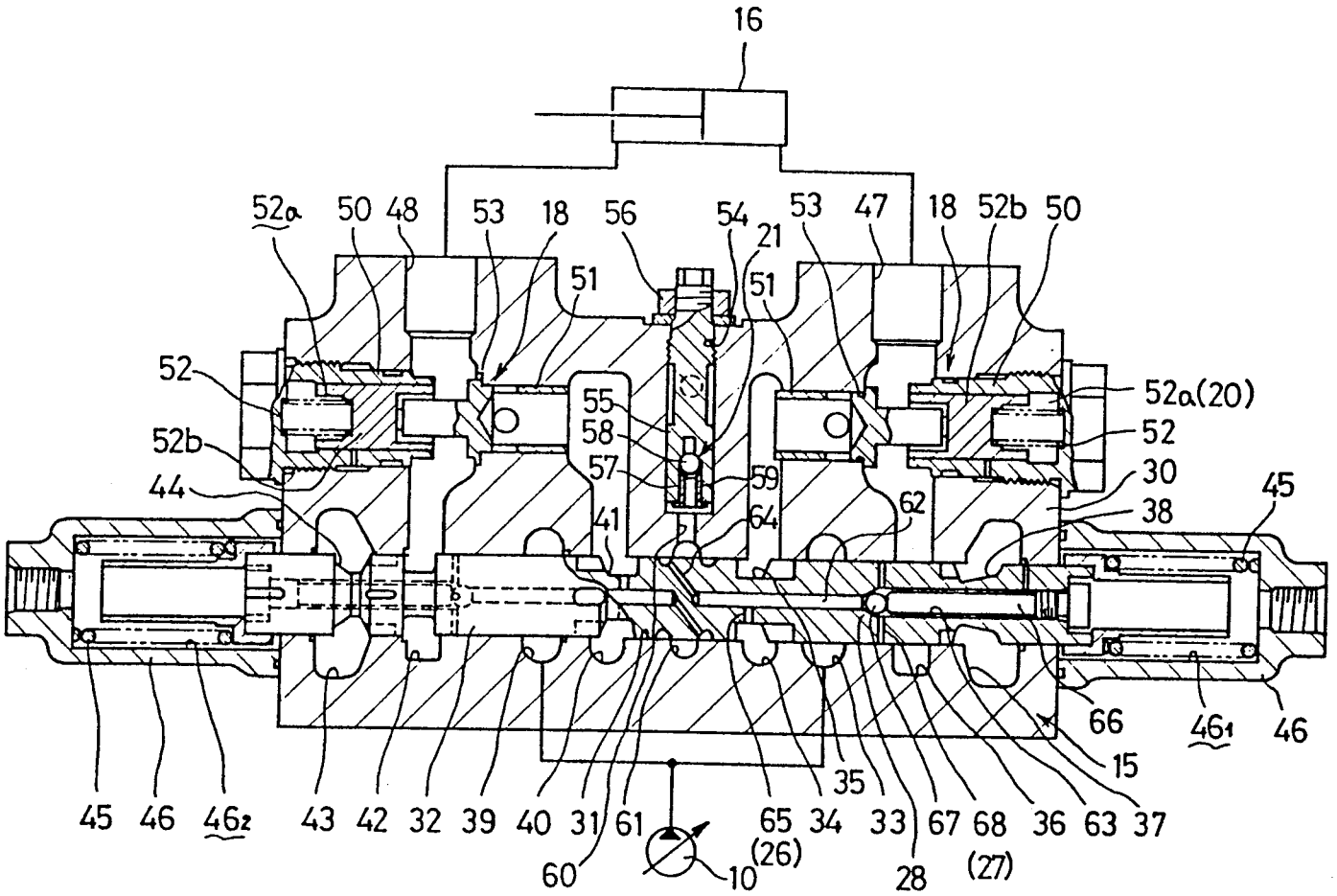

A first oil hole 62 and a first shaft opening 63 are formed of an axis of the spool 32 as shown in a right half portion of FIG. 1. The first oil hole 62 has an end which is opened to communicate with the load pressure detection port 61 by means of a first communicating opening 64 and also opened to the first small diameter section 35 by means of a thin opening 65 and the thin opening 65 comprises the first restriction 26 which is described with reference to FIG. 2. A ball 67 is arranged movably between another end of the first oil hole 62 and a forward end of a holding rod 66 which is inserted in the first shaft opening 63 from the outer end thereof, so as to comprise the check valve 28, as described with reference to FIG. 2. Further, at an end of the first shaft opening 63 and also a position where the check valve 28 may be operable, a thin opening 68 is formed to open outward of the periphery of the spool 32 and the thin opening 68 comprises the second restriction 27 which is described with reference to FIG. 2. Further, openings for forming a second oil hole, a second shaft opening, a first restriction and a second restriction as well as a check valve, which are the same as those mentioned above, are provided with the left half portion of the spool 32 in the drawings.

The operation valve with the pressure compensation valve according to the present invention as mentioned above, operates as follows. When a pilot pressure oil is supplied to the second pressure receiving section $46_2$ and the spool 32 is moved to the right direction in the drawing, the first small diameter section 35 bridges the first inlet passage 33 and the first outlet passage 34 to communicate therewith. At the same time, the fourth small diameter section 44 bridges the second return passage 42 and the second tank communicating passage 43 to communicate therewith and then the first communicating opening 64 communicates the load detecting port 61 and the thin opening 68 communicates the first return passage 36.

As the result, the load detecting port 61 opens to the first outlet passage 34 via the first communicating opening 64, the first oil hole 62 and the thin opening 65, and where the check valve 28 is opened, the port 61 opens to the first return passage 36 via the thin opening 68 and therefore an intermediate pressure between the inlet pressure and the outlet pressure of the pressure compensation valve 18 is supplied to the spring chamber **52*a*, i.e. the second pressure receiving section 20, as it is also seen in the circuit of FIG. 2** and controlled.

Possibility of Utilization in Industry

According to the present invention, a load pressure introducing passage, a restriction and a check valve are formed with a spool and an intermediate pressure between the inlet pressure and the outlet pressure of a pressure compensation valve is detected by a load pressure detecting port and then supplied to the pressure receiving section thereof. Therefore, it is not necessary to provide the above mentioned oil holes and check valve specially with the valve body and its valve construction becomes simple. As the result, it becomes possible to easily increase a precision in processing and it contributes a progression of productivity.

What is claimed is:

1. An operation valve with pressure compensation valves, comprising:

a valve body having a fluid inlet, a load pressure detecting port, fluid outlet passages and fluid return passages;

a changeable spool slidably mounted in a bore in said valve body;

a pair of pressure compensation valves provided in said valve body with each pressure compensating valve controlling fluid flow from one of said outlet passages;

a pair of oil passages formed along an axis of said spool, each respective oil passage having a first end opening which is movable with said spool into fluid communication with said load pressure detecting port of said valve body;

a pair of check valves with each check valve disposed adjacent a second end of one of said oil passages;

a pair of small hole openings with each small hole opening movable with said spool to provide fluid communication between one of said oil passages and an outlet passage, each small hole opening constituting a first restriction located at a position between said first end opening and said check valve of each respective oil passage;

a pair of thin fluid passages with each thin fluid passage movable with said spool to provide fluid communication between one of said oil passages and a return passage, each thin fluid passage constituting a second restriction located more distant from said first end opening than said check valve of each respective thin fluid passage; and said first end opening and said small hole opening of each respective oil passage provides fluid communication between one of said outlet passages and said load pressure detecting port when said spool is moved to align said first end opening with said load pressure detecting port.

2. The operation valve as defined by claim 1 wherein said oil passages are formed coaxial with each other and each of said oil passages including said check valve, said small hole first restriction opening and said thin fluid second restriction passage is formed symmetrical with the other oil passage.

* * * * *